US005190236A

United States Patent [19]

Groos et al.

[11] Patent Number: 5,190,236

[45] Date of Patent: Mar. 2, 1993

[54] WIRE COILER WITH ROTATING WINDING DRUM

[75] Inventors: Horst Groos, Mettmann; Bernhard Zeuch, Ratingen, both of Fed. Rep. of Germany

[73] Assignee: SMS Hasenclever GmbH, Duesseldorf, Fed. Rep. of Germany

[21] Appl. No.: 751,537

[22] Filed: Aug. 29, 1991

[30] Foreign Application Priority Data

Sep. 18, 1990 [DE] Fed. Rep. of Germany ..... 4029494

[51] Int. Cl.[5] ..... B21C 47/02

[52] U.S. Cl. ..... 242/81

[58] Field of Search ..... 242/78, 79, 81, 83, 242/84

[56] References Cited

U.S. PATENT DOCUMENTS

| | | | |
|---|---|---|---|
| 381,199 | 4/1888 | Young | 242/81 |
| 444,550 | 1/1891 | Daniels | 242/81 |
| 1,762,289 | 6/1930 | Dahlstrom | 242/81 |
| 2,781,179 | 2/1957 | O'Malley | 242/81 |
| 3,926,382 | 12/1975 | Sieurin et al. | 242/79 |

FOREIGN PATENT DOCUMENTS

| | | |
|---|---|---|
| 44693 | 10/1888 | Fed. Rep. of Germany . |
| 45201 | 12/1888 | Fed. Rep. of Germany . |
| 197149 | 6/1905 | Fed. Rep. of Germany . |
| 1752791 | 3/1971 | Fed. Rep. of Germany . |
| 1959972 | 6/1971 | Fed. Rep. of Germany . |

*Primary Examiner*—Stanley N. Gilreath

*Attorney, Agent, or Firm*—Jacobson, Price, Holman & Stern

[57] ABSTRACT

A wire coiler with a rotating winding drum which can be immersed in a water tank as a rotational body having the greatest possible smoothness in order to avoid energy-dissipating turbulence of the water in the tank includes a winding drum (1) open towards the top and formed by outer and inner spaced casings (2, 3), and a base (4) connecting the casings and a vertical rotatable shaft (8) connected by flanges (5, 7) to the drum. The inner casing of the winding drum is breached by vertical slots (16), and an annular disc (15) inserted into the winding drum for supporting the turns of the wire coil being formed is connected to a lifting device (19, 21) by crosspieces (17) engaging through the slots, whereby the lifting device raises the supporting surface of the disc to a level with the transfer plane of the wire coils. A lifting sleeve (19) connected to the stationary lifting device (21) surrounds the shaft and has an annular groove (20) which engages the inner ends of the crosspieces to form a rotatingly movable, axially fixed connection, and is movably arranged in the annular space within the inner casing.

9 Claims, 3 Drawing Sheets

WIRE COILER WITH ROTATING WINDING DRUM

BACKGROUND OF THE INVENTION

For the purposes of coiling wire of non-circular cross-section, as is produced in particular in extruders, wire coilers with a rotating winding drum are required since these wind the wire in a twist-free manner, unlike the wire coilers with a stationary drum and a rotating laying tube. If a particularly fast cooling of the wire, which issues from a rolling mill or an extruder hot as a result of rolling or extrusion, is necessary in order to prevent its oxidation and scale formation and/or to give rise to a particular structural development in the wire, the winding drums of the wire coilers used are immersed in a water tank, wherein the components—rotating in the water—of these wire coilers are to be formed as rotational bodies of the greatest possible smoothness in order to prevent energy-dissipating turbulence of the water in the tank. For reasons of standardization, keeping replacement parts and possible subsequent installation of a water tank, it is advantageous to provide a uniform design of the wire coiler, even without a water tank.

The aforesaid requirements of wire coilers are fulfilled by the use of a winding drum which is open towards the top and formed by an outer and an inner casing or wall and a base connecting the said outer and inner casings, which winding drum is flanged onto a vertical shaft and is rotatable therewith, wherein the inner casing of the winding drum is breached by vertical slots and wherein an annular disc, inserted into the winding drum and carrying the turns of the wire coil being formed, is connected to a lifting device by means of radial inward projections or arms passing through the slots, by which lifting device the supporting surface of the disc can be lifted above the winding drum to be positioned level with the transfer plane for the wire coils. These wire coilers, which are widely used in practice, are known for example from German patent specifications 45 201, and 1 752 791 and, in connection with a water tank in which the winding drum is immersed, the shaft of which is guided through the base of the water tank, from German patent specification 1 959 972.

In the case of wire coilers of this type, the rotating lifting device connected to the disc is housed centrally in the shaft for the winding drum, which shaft is hollow.

Although this requires great structural expenditure with correspondingly high costs and prevents the use of standardized structural elements, preference was given to the generic connection of the disc to the lifting device by means of arms projecting through the slots in the inner casing as opposed to a connection of the disc to the lifting device through the base of the winding drum (German patent specification 197 149) or the outer casing (German patent specification 44 693) since these designs are less suitable or unsuitable in the case of a winding drum immersed in a water tank.

The aim of the invention is to attain a structural simplification of a wire coiler permitting extensive use of standardized structural elements (gearing, piston-cylinder units), while the rotating components are formed of rotational bodies of the greatest possible smoothness, with the result that the wire coiler can be operated also in connection with a water tank with an immersed winding drum and water turbulence can be largely avoided.

SUMMARY OF THE INVENTION

The invention provides, in a wire coiler of the type including: a rotatable annular winding drum having an inner wall, an outer wall, an open top between said walls, and a base interconnecting said walls, all having a common vertical axis; a vertical drive shaft coaxial with and rotationally coupled to the winding drum at an upper region of said inner wall; a plurality of axially elongate apertures provided in said inner wall; an annular coil support member disposed in said drum between said inner and outer walls and vertically movable relative to said walls; and a plurality of coupling members each coupled to said coil support member, extending through respective ones of said apertures and movable vertically along said apertures; the improvement comprising: a vertically movable annular lifting member coaxial with and between said inner wall and said shaft; said lifting member being coupled to said coupling members for lifting said coupling members and therewith said coil support member; and static lifting drive means for lifting said annular lifting member being; said annular lifting member provided between said lifting drive means and said coupling members to provide a positive coupling in the vertical lifting direction while permitting rotation of the coupling members relative to the lifting drive means.

In accordance with a preferred embodiment of the invention, a sleeve, connected to a stationary lifting device surrounding the shaft, engages around the arms projecting through slots in the inner casing to form a rotatingly movable, axially fixed connection with an annular groove, and is movable in the annular space between the inner casing and the shaft flanged onto the upper end of the inner casing.

It can be advantageous if the sleeve is formed by a tubular body which has axial dimensions corresponding to the height of the winding holder and is provided on its lower end with a flange, via which the sleeve is connected to three or more lifting cylinders distributed about the bearing housing of the shaft and controlled synchronously, since the flange permits the arrangement of the lifting cylinders and, where appropriate, of guide rods for the sleeve, on a relatively large pitch circle. The enlargement of the water tank which is necessary as a result is not a disadvantage since a larger volume of water reduces the temperature fluctuations of the water and can therefore be desirable.

BRIEF DESCRIPTION OF THE DRAWINGS

Wire coilers according to embodiments of the invention will now be described, by way of example only, with reference to the accompanying drawings, in which.

DESCRIPTION OF PREFERRED EMBODIMENTS

Figure 1:
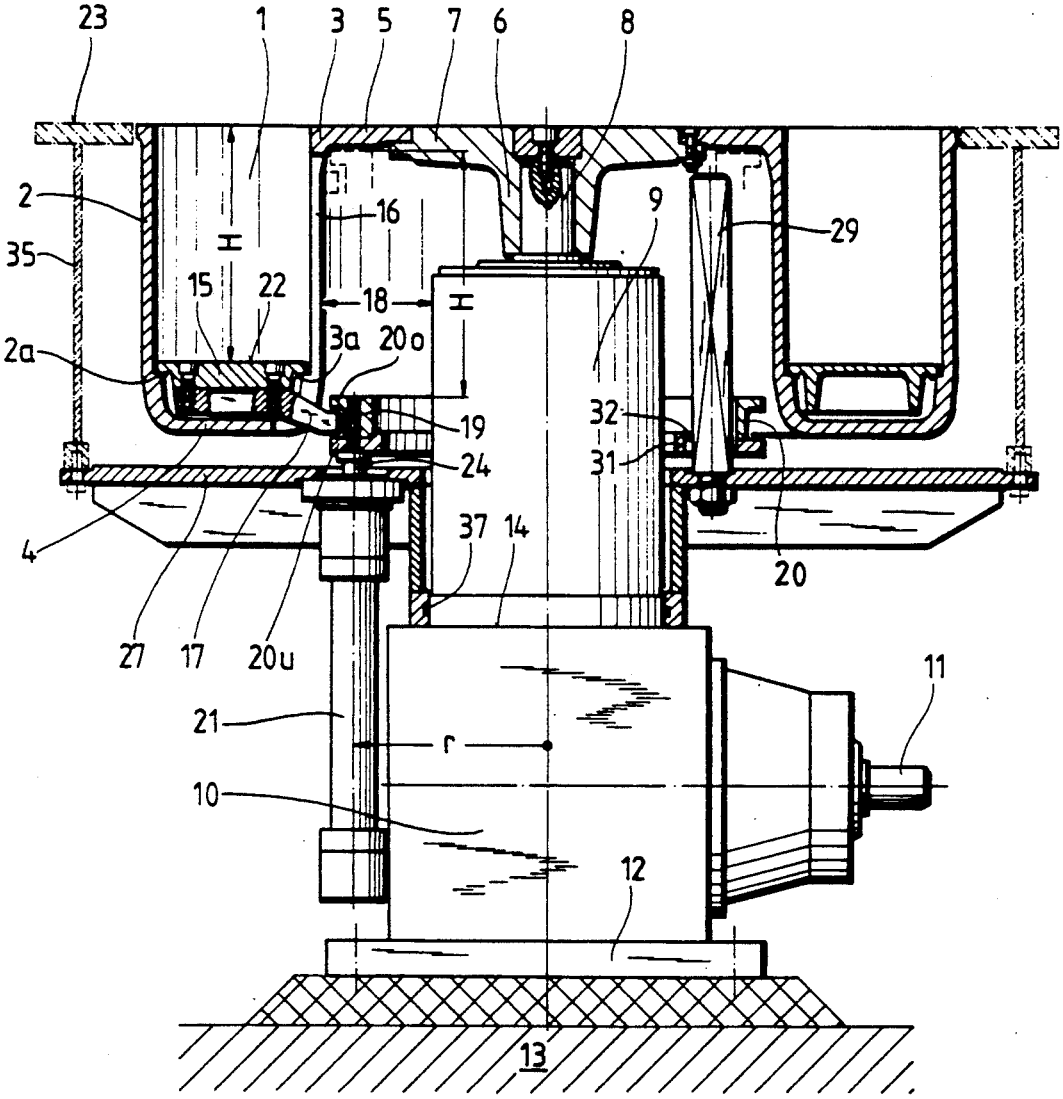
FIG. 1 shows an embodiment of the invention in vertical cross section through the central axis.
Figure 2:
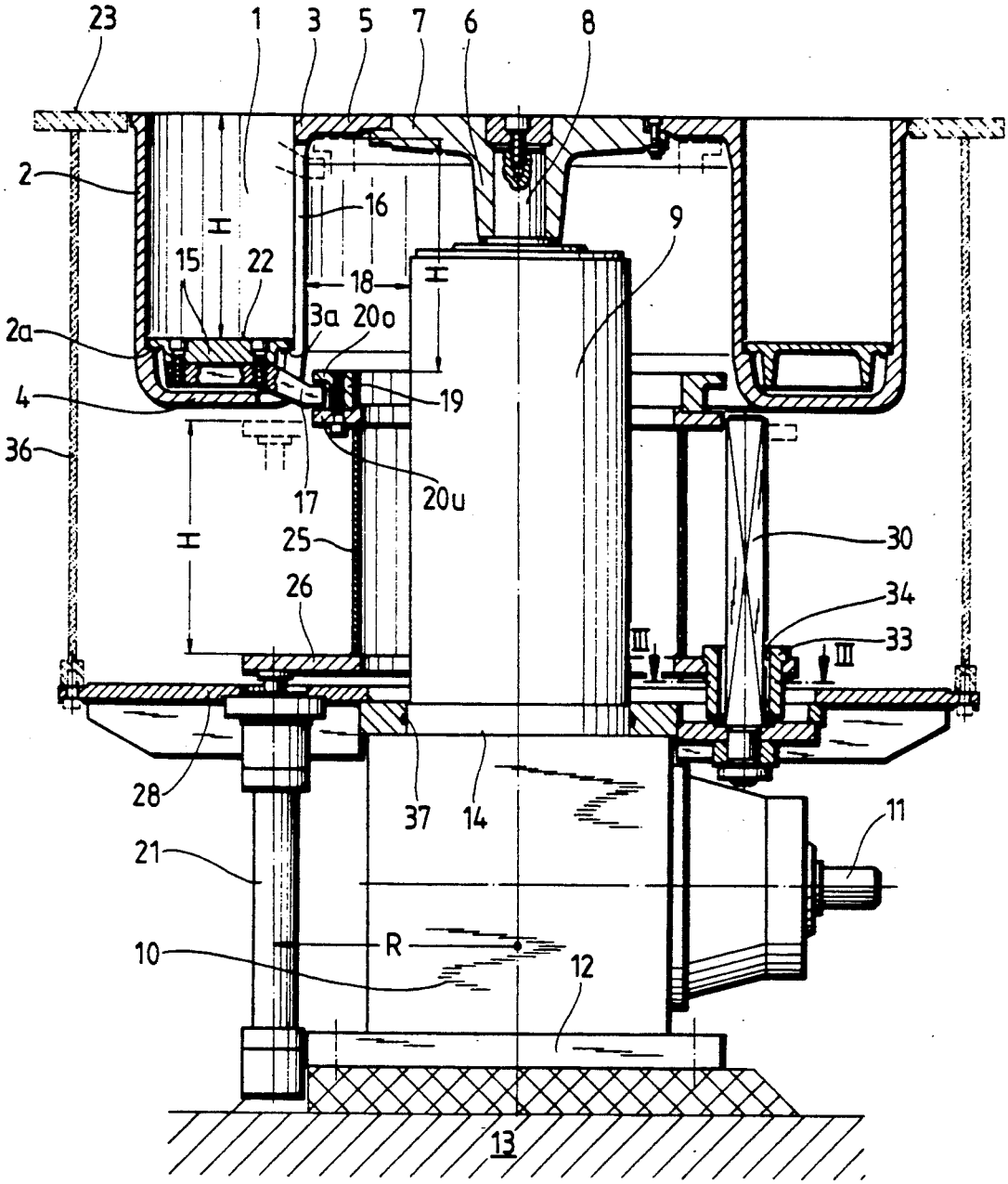
FIG. 2 is a view similar to FIG. 1 of another embodiment of the invention.

In the embodiment according to FIG. 1 and also in that according to FIG. 2, 1 designates a winding drum which is formed by an outer casing or wall 2, an inner casing or wall 3, and a base 4 connecting the walls or casings 2 and 3. On the upper edge of the inner casing 3, the latter is provided with a flange 5 directed inwards. This flange 5 is connected to a flanged part 7 of a hub 6. The hub 6 with its flanged part 7 is supported on a shoulder of a vertical shaft 8 and is connected to the shaft 8 so as to be rotationally rigid, by which means the winding drum 1 is also connected to the shaft 8. The shaft 8 is rotatably and axially supported in a housing 9 which is provided with bearings which are not shown (radial bearings and axial bearings). The shaft 8 is driven via a bevel gear transmission 10 by a motor (not shown) which is connected to the drive shaft 11 of the bevel gearing. The bevel gear transmission 10 is anchored to a bed 13 by a base plate 12. Opposite the base plate 12, the housing of the bevel gear transmission 10 is provided with a connecting flange 14 which serves to support and center the housing 9 with the shaft 8.

An annular coil support disc or plate 15 is inserted into the winding drum 1 between its outer casing 2 and its inner casing 3, which disc is carried by shoulders 2*a* and 3*a* of the casings 2 and 3 near the base 4 of the winding drum 1. The inner casing 3 of the winding drum 1 is breached by vertical slots 16. Inwardly projecting arms 17, which are connected to the disc 15, project through the slots 16 into the annular internal space 18 between the inner casing 3 and the housing 9 for the shaft 8. A sleeve 19 is provided which has an external, annular groove 20 facing outwards and bounded by upper and lower flanges 20*o* and 20*u*. The groove 20 engages around the free inner ends of the arms 17 with radial and axial clearance. By means of a lifting device formed by at least three piston-cylinder units 21 distributed on a pitch circle, coaxial with shaft 8, the disc 15 can be lifted via the sleeve 19 and the arms 17 far enough for its uppermost supporting surface 22 to come to lie flush with the upper edge of the winding drum 1 and the adjacent transfer plane 23, with the result that a wire coil formed on the disc 15 by the accumulated wire turns can be transferred. Suitable known means are provided for operating the cylinders 21 synchronously. During the lifting of the disc 15 by the piston-cylinder units 21, the winding drum 1 does not rotate, while when the sleeve 19 is lowered, there is sufficient clearance for the arms 17, which rotate with the winding drum 1, to rotate unobstructed.

In the embodiment according to FIG. 1, the piston rods 24 of the piston-cylinder units 21 are directly connected to the sleeve 19, resulting in a very compact construction. This method of construction presupposes that the piston-cylinder units 21 are arranged on a pitch circle of radius r which is dimensioned so as to be correspondingly smaller than the inner diameter of the inner casing 3 of the winding drum 1.

In contrast, in the embodiment according to FIG. 2, the piston-cylinder units 21 are provided on a relatively large pitch circle of radius R, as can be desirable or necessary. Furthermore, the sleeve 19 is formed as an upper closure of a tubular body 25 which is provided on its lower end with a flange 26 extending outwards. The piston-cylinder units 21 are connected to the sleeve 19 via the tubular body 25, the axial dimensioning of which is adapted to the height of lift H of the disc 15, and via the lower flange 26 of the tubular body 25.

In the embodiment according to FIG. 1, the piston-cylinder units 21 of the lifting devices are carried by a collar plate 27. The collar plate 27 sits on the connecting flange 14 of the bevel gearing 13 and is centered and fastened there. Offset in relation to the piston-cylinder units 21, the collar plate 27 is provided with at least three guide rods 29. The guide rods 29 directly guide the sleeve 19 which is furthermore provided with eyes 31 in which are guide apertures 32.

In the embodiment according to FIG. 2, the piston-cylinder units 21 of the lifting devices are carried by a collar plate 28. The collar plate 28 sits on the connecting flange 14 of the bevel gearing 13 and is centered and fastened there. Offset in relation to the piston-cylinder units 21, the collar plate 28 is provided with guide rods 30. The flange 26 for the tubular body 25 is provided with bushes 33 in which are guide apertures 34 which slide along the guide rods 30 and guide the tubular body 25 with flange 26 and sleeve 19.

Figure 3:
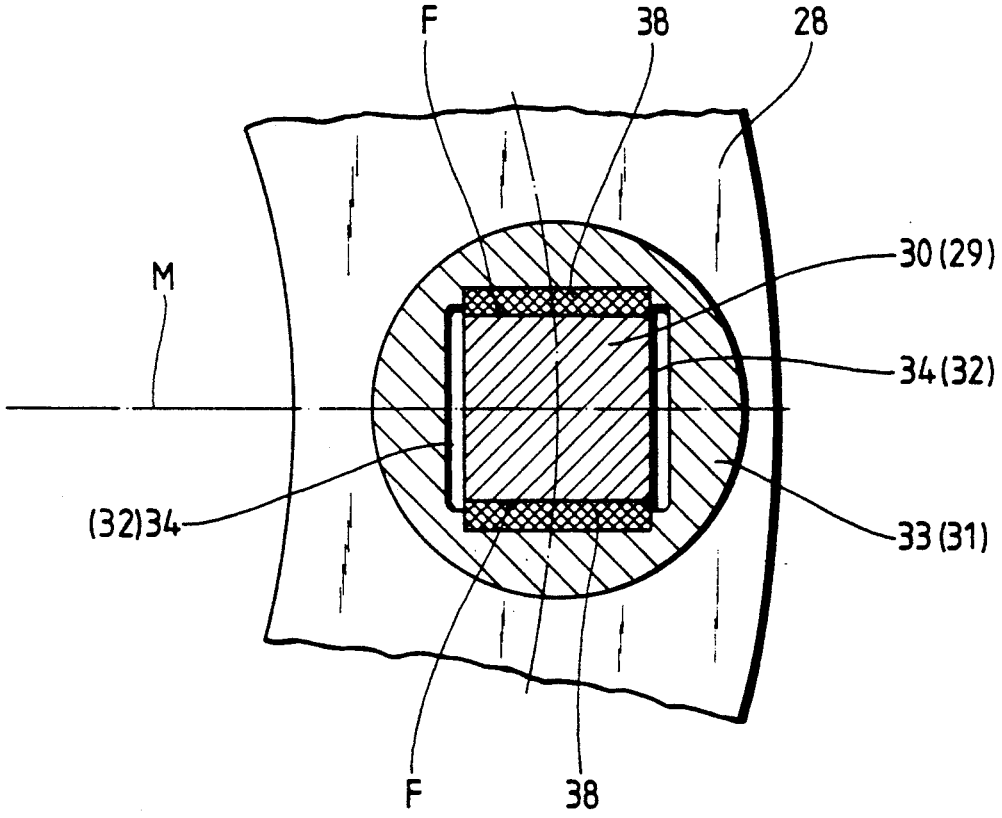
FIG. 3 is a cross-sectional detail on a larger scale taken along line III—III of FIG. 2.

As can be seen from FIG. 3, which shows a section along the section line III—III in FIG. 2, the guides are flat guides and the guide rods 30 are correspondingly flattened parallel to their central plane M which is orientated towards the main axis; and the guide rods 30 are of square cross-section in the illustrated embodiment. The guide rods 30 have radial clearance in relation to the guide apertures 34 in the bushes 33, while adjacent the guide surfaces F on the guide rods 30 the apertures 34 are occupied by guide plates 38, with the result that the sleeve 19 with tubular body 25 and flange 26 is centered in relation to at least three guide rods 30, but expansion differences caused by varying heating of components, and the axial movement, can take place unrestrictedly. This is of particular importance if the wire coiler is operated "dry", i.e. without the winding drum 1 being immersed, since then a greater heating of the winding drum 1 and directly adjacent components (sleeve 19) in relation to the remaining components (collar plate 28) can occur as a result of the hot wire turns.

The coiler of FIG. 1 can have an analogous construction and FIG. 3 shows in parentheses the reference numbers appropriate to the FIG. 1 embodiment. The guides are flat guides and the guide rods 29 are correspondingly flattened parallel to their central plane M which is orientated towards the main axis; in particular the guide rods 29 are of square cross-section in the embodiment. The guide rods 29 have radial clearance in relation to the guide apertures 32 in the lugs 31, while adjacent the guide surfaces F on the guide rods 29 are guide plates 38 with the result that the sleeve 19 is centered in relation to at least three guide rods 29, but expansion differences caused by varying heating of components, and the axial movement, can take place unrestrictedly.

The wire coiler according to FIG. 1 and that according to FIG. 2 are both suitable to be operated with a winding drum 1 immersed in water, for which purpose only an appropriate tank casing 35 (FIG. 1) or 36 (FIG. 2) has to be mounted onto the collar plate 27 or 28 and the requisite water connections provided. The collar plate 27 or 28 then serves as the base of the water tank, for which purpose the collar plate 27 or 28 is to be provided with a seal 37 on the seat for the connecting flange 14 of the bevel gearing 13. The greater volume of water present in the embodiment according to FIG. 2 as a result of the greater distance of the collar plate or base plate 28 from the winding drum 1 is not a disadvantage but can be desirable in order to hold temperature fluctuations of the water within narrow limits.

In the described embodiments the sleeve 19 has an annular external groove with upper and lower flanges.

The upper flange may be omitted, if gravity alone is sufficient to ensure the return of the disc 15 from its raised to its lowered position when the units 21 are retracted.

In the described embodiments, the sleeve 19 is non-rotatable. In an alternative arrangement, the non-rotatable sleeve 19 may be replaced by a ring which is attached to and rotates with the arms 17, this ring being disposed above, and therefore liftable by, the piston-cylinder units 21, optionally with a stationary ring interposed between the unit 21 and the rotatable lifting ring.

We claim:

1. In a wire collar including:

a rotatable annular winding drum having an inner wall, an outer wall radially spaced from said inner wall, an open top between said walls, and a base interconnecting said walls, all having a common vertical axis, a vertical drive shaft coaxial with and rotationally coupled to said winding drum at an upper region of said inner wall, a plurality of axially elongate apertures provided in said inner wall, an annular coil support member disposed in said drum between said inner and outer walls and vertically movable relative to said walls, and a plurality of coupling members each coupled to said coil support member and extending through respective ones of said apertures and movable vertically along said apertures, the improvement comprising:

a vertically movable annular lifting member coaxial with and movable between said inner wall and said shaft, said lifting member being coupled to said coupling members for lifting said coupling members and therewith said coil support member;

static lifting drive means for lifting said annular lifting member; and means for coupling said annular lifting member to said lifting drive means so that a freely rotatable coupling is provided between said lifting drive means and said annular coil support member.

2. A wire coiler comprising:

an annular winding drum having an upright axis and being open towards the top thereof, said drum being formed by an outer casing, an inner casing radially spaced from said outer casing and a base connecting said casings and being immersable in a water tank;

a shaft rotatably supported in radially spaced relationship relative to said winding drum to form an annual space between said inner casing and said shaft for rotation about a vertical axis;

vertical slots in said inner casing of said winding drum;

an annular disc in said winding drum between said inner and outer casings;

a supporting surface on said disc for supporting turns of the wire coil being formed;

inward projections on said annular disc extending through said slots; and a stationary lifting device comprising a sleeve movable in said annular space and surrounding said shaft, an annular groove in said sleeve slidably engaging said projections forming a rotatingly movable, axially fixed connection, and lifting means for raising said sleeve and there with said annular disc and said supporting surface thereof to a transfer position above the winding drum for facilitating transfer of the wire coils.

3. A wire coiler as claimed in claim 2 and further comprising:

a shaft housing surrounding said shaft so that said annular space is between said inner casing and said shaft housing.

4. A wire coiler as claimed in claim 3 wherein:

said sleeve comprises a tubular body having an axial dimension extending in the axial direction of said winding drum and a lower flange on said sleeve; and said lifting means comprises at least three lifting cylinders distributed in circumferential spaced relationship about said shaft, means for operating said at least three cylinders synchronously, and means for coupling said at least three cylinders to said lower flange.

5. A wire coiler as claimed in claim 4 and further comprising:

at least three upwardly extending circumferentially spaced guide rods slideably engaging said sleeve for guiding said sleeve on said guide rods, said guide rods having central axially extending planes and extending towards the axis of said drum;

lateral guide surfaces on each guide rod extending parallel to the respective central planes;

guide plates on said sleeve slidingly engaging said lateral guide surfaces on said guide rods for locating and guiding said sleeve circumferentially; and radial clearances between said guide rods and said sleeve.

6. A wire coiler as claimed in claim 3 and further comprising:

at least three upwardly extending circumferentially spaced guide rods slideably engaging said sleeve for guiding said sleeve on said guide rods, said guide rods having central axially extending planes and extending towards the axis of said drum;

lateral guide surfaces on each guide rod extending parallel to the respective central planes;

guide plates on said sleeve slidingly engaging said lateral guide surfaces on said guide rods and locating and guiding said sleeve circumferentially; and radial clearances between said guide rods and said sleeve.

7. A wire coiler as claimed in claim 2 wherein:

said sleeve comprises a tubular body having an axial dimension extending in the axial direction of said winding drum and a lower flange on said sleeve; and said lifting means comprises at least three lifting cylinders distributed in circumferential spaced relationship about said shaft, means for operating said at least three cylinders synchronously, and means for coupling said at least three cylinders to said lower flange.

8. A wire coiler as claimed in claim 7 and further comprising:

at least three upwardly extending circumferentially spaced guide rods slideably engaging said sleeve for guiding said sleeve on said guide rods, said guide rods having central axially extending planes and extending towards the axis of said drum;

lateral guide surfaces on each guide rod extending parallel to the respective central planes;

guide plates on said sleeve slidingly engaging said lateral guide surfaces on said guide rods for locating and guiding said sleeve circumferentially; and radial clearances between said guide rods and said sleeve.

9. A wire coiler as claimed in claim 2 and further comprising:

at least three upwardly extending circumferentially spaced guide rods slideably engaging said sleeve for guiding said sleeve on said guide rods, said guide rods having central axially extending planes and extending towards the axis of said drum;

lateral guide surfaces on each guide rod extending parallel to the respective central planes;

guide plates on said sleeve slidingly engaging said lateral guide surfaces on said guide rods for locating and guiding said sleeve circumferentially; and radial clearances between said guide rods and said sleeve.

* * * * *